US006032625A

United States Patent [19]

Schwegler

[11] Patent Number: 6,032,625

[45] Date of Patent: Mar. 7, 2000

[54] VARIABLE VALVE CONTROL FOR INTERNAL COMBUSTION ENGINES

[75] Inventor: Roland Schwegler, Weinstadt, Germany

[73] Assignee: DalmerChryslerAG, Stuttgart, Germany

[21] Appl. No.: 09/173,391

[22] Filed: Oct. 15, 1998

[30] Foreign Application Priority Data

Oct. 24, 1997 [DE] Germany ..... 197 47 031

[51] Int. Cl.[7] ..... F01L 1/34; F01L 1/04

[52] U.S. Cl. ..... 123/90.17; 123/90.27; 123/90.31

[58] Field of Search ..... 123/90.15, 90.16, 123/90.17, 90.27, 90.31

[56] References Cited

U.S. PATENT DOCUMENTS

| | | | |
|---|---|---|---|
| 4,535,733 | 8/1985 | Honda | 123/90.17 |
| 4,546,735 | 10/1985 | O'Neal | 123/90.17 |
| 4,862,845 | 9/1989 | Butterfield et al. | 123/90.15 |
| 4,976,229 | 12/1990 | Charles | 123/90.17 |
| 4,986,801 | 1/1991 | Ohlendorf et al. | 123/90.17 |
| 5,052,350 | 10/1991 | King | 123/90.16 |
| 5,178,105 | 1/1993 | Norris | 123/90.15 |
| 5,431,132 | 7/1995 | Kreuter et al. | 123/90.16 |
| 5,540,197 | 7/1996 | Golovatai-Schmidt et al. | 123/90.17 |
| 5,555,860 | 9/1996 | Wride | 123/90.16 |
| 5,586,527 | 12/1996 | Kreuter | 123/90.15 |
| 5,592,906 | 1/1997 | Kreuter et al. | 123/90.16 |

FOREIGN PATENT DOCUMENTS

| | | |
|---|---|---|
| 42 44 550 | 7/1994 | Germany . |
| 43 00 684 | 7/1994 | Germany . |
| 195 49 331 | 8/1996 | Germany . |

*Primary Examiner*—Weilun Lo
*Attorney, Agent, or Firm*—Klaus J. Bach

[57] ABSTRACT

In a variable valve control for an internal combustion engine with a cylinder head having a first camshaft controlling the opening of the engines intake valves and a second camshaft for controlling the closing of the engines intake valve, a control drive for driving the second camshaft at a variable angular position relative to the first camshaft so as to permit controlling the intake valve opening duration, a control wheel with an eccentric collar for actuating the control drive and a control motor for operating the control wheel, all mounted on a bearing housing supporting the camshafts, the control wheel is mounted on the bearing housing sidewardly displaced from the control drive and the control motor has a drive shaft which extends transversely to the axis of the control wheel and is supported on the camshaft bearing housing.

8 Claims, 1 Drawing Sheet

VARIABLE VALVE CONTROL FOR INTERNAL COMBUSTION ENGINES

BACKGROUND OF THE INVENTION

The invention relates to a variable valve control for an internal combustion engine having a cylinder head with a valve operating mechanism including a first camshaft with cams for controlling the opening of the engine intake valves and a second camshaft for controlling the closing of the intake valves and a coupler drive disposed between the first and second camshafts for driving the second camshaft with a variable angular position relative to the first camshaft so that the intake valve opening duration can be controlled by controlling the coupler drive.

Variable valve controls of this type are known for example from DE 42 44 550 A1, particularly for the throttle-free load control of gasoline engines by changing the lift and/or opening duration of the intake valves of which each cylinder has at least one. The arrangement of such valve controls includes essentially two camshafts which rotate in opposite directions and which act by way of rocker arms on valves which are spring loaded in a valve closing direction. A first one of the camshafts determines the opening function and the second camshaft controls the closing of the intake valve so that, by changing the angular positions of the camshafts relative to each other, the lift and the opening duration of the valves can be changed in a wide range.

For changing the angular position of the camshafts relative to each other a four gear coupler drive is provided whose input gear is mounted on the first camshaft for rotation with the first crankshaft. The final gear of the coupler drive is mounted on the second camshaft for driving the second camshaft at a variable angular position relative to the first camshaft. The coupler drive includes two intermediate gears which are held in engagement with each other and with the input and the final gears respectively, by coupling arms so that pivoting of the coupling arms about the camshafts forming the pivot axes results in a rotation of the two camshafts relative to each other. The pivoting of the coupling arms is effected in the known designs by a control member which acts on one of the coupling arms and is part of the coupler drive. The control member is supported on the camshaft together with the coupling arm and is actuated by a control motor.

Such a control arrangement is not particularly flexible with respect to the available space, it has a given motion transfer ratio and it is furthermore subjected to the vibrations of the camshaft because it is supported on the camshaft.

It is the object of the present invention to provide a coupler drive arrangement for the camshafts which has good flexibility as to its spatial arrangement and which is not subjected to the vibrations of the camshaft.

SUMMARY OF THE INVENTION

In a variable valve control for an internal combustion engine with a cylinder head having a first camshaft controlling the opening of the engines intake valves and a second camshaft for controlling the closing of the engines intake valves, a control drive for driving the second camshaft at a variable angular position relative to the first camshaft so as to permit controlling the intake valve opening duration, a control wheel with an eccentric member for actuating the control drive and a control motor for operating the control wheel, all mounted on a camshaft bearing housing supporting the camshafts, the control wheel is mounted on the camshaft bearing housing sidewardly displaced from the control drive and the control motor has a drive shaft which extends transversely to the axis of the control wheel and is supported on the camshaft bearing housing.

With the arrangement according to the invention, the pivotable space can be better utilized and the transmission of camshaft vibrations to the control drive is eliminated since there is no direct connection between the camshaft and the control drive. The control arrangement for the control drive may be placed in any suitable location as long as a convenient connection between the control arrangement and the control drive can be established. It is advantageous if an eccentric member is associated with the control wheel and the eccentric member is connected to the control drive by a connecting rod which is supported on one of the connecting joints of the coupling arms of the control drive. Also, the control wheel, the eccentric member, and the control drive should be arranged in the same plane in order to provide for a narrow space-saving arrangement.

With a four gear coupler drive, which is the preferred control drive, the connecting rod is preferably supported at one end on one of the shafts supporting the intermediate gears of the coupler drive whereby the design and construction expenditures are relatively low. With the control wheel including an eccentric member on which the connecting rod is supported, the transmission ratio between the control motor and the coupler drive is variable in a wide control range. It can be so selected that the control movement is very sensitive in certain control areas of the control range, for example, during engine idling where fine control adjustments are needed. If the control motor drives the control wheel by way of a worm gear drive the transmission ratio can be high and, furthermore, the control motor can easily be arranged at particularly suitable locations also at locations where its drive shaft extends at other than right angles to the axis of the control motor.

Altogether, the control arrangement according to the invention is preferably disposed at the front end of a bearing housing for the camshafts wherein, by the possibility of positioning the control wheel apart from the coupler drive and the control motor in various ways relative to the control wheel, a large degree of freedom for the design of the arrangement is provided.

The invention will become more readily apparent from the following description of an embodiment thereof on the basis of the accompanying drawings.

DESCRIPTION OF A PREFERRED EMBODIMENT

Internal combustion engines with cylinder heads including intake and exhaust passages and intake and exhaust valves with camshafts for operating the valves are well known. Such an engine is described, for example in co-pending application Ser. No. 09/173,387, which is made part of the present application by reference thereto. The invention is based on such an engine. The intake and exhaust valves are spring-loaded valves which are held closed by the valve springs and which are operated by the cams of two camshafts of which one controls the opening and the other controls the closing of the intake valves. Such a valve control is known, for example, from DE 42 44 550 A1 to which reference is made.

This publication also discloses a control drive by way of which the angular positions of the two camshafts are adjustable relative to each other so that the opening duration of the intake valves can be adjusted within a certain control range.

Figure 1:
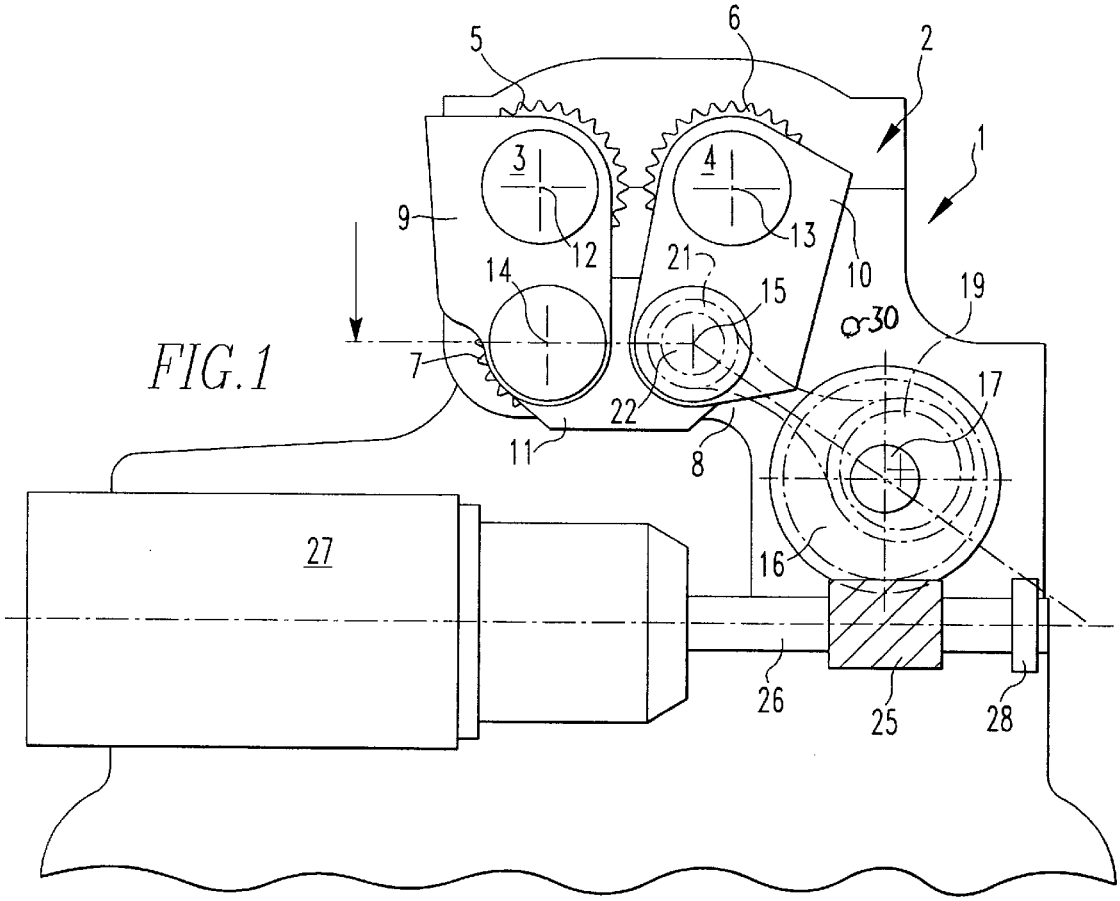
FIG. 1 shows schematically the front end of a camshaft bearing housing with a coupler drive for the camshafts and the operating mechanism therefor.
Figure 2:
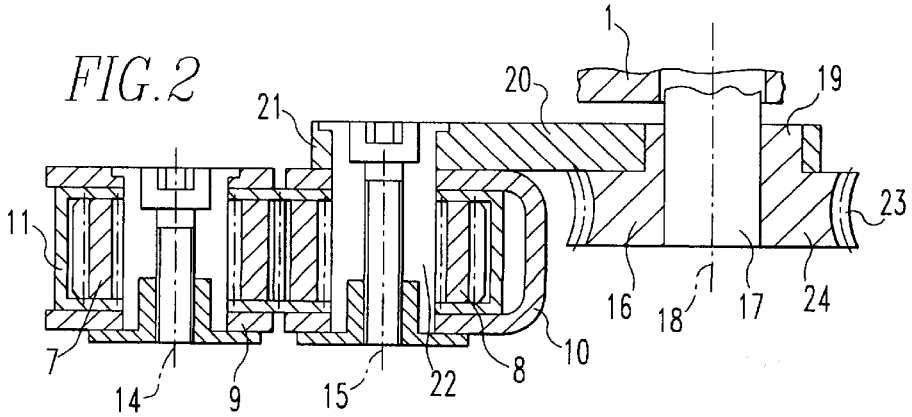
FIG. 2 is a cross-sectional view taken along line II—II of FIG. 1 showing, however, only a small part of the camshaft bearing housing.

As a control drive, a four-gear coupler drive is used as it is shown schematically in FIG. 1. FIG. 1 shows a camshaft bearing housing 1 which is disposed on the cylinder head or is part of the cylinder head of an internal combustion engine. It includes at its front end, a control drive 2 in the form of a four-gear coupler drive. The coupler drive 2 disposed at the front end of the bearing housing which supports the parallel camshafts 3 and 4 includes gears 5 and 6, which are firmly mounted on the respective camshafts 3 and 4 for rotation therewith. The gears 5 and 6 are in meshing engagement with the intermediate gears 7 and 8 and the intermediate gears 7 and 8 are held in engagement with each other by coupler arms 9, 10, and 11 so that a motion transmission is established between the camshaft gears 5 and 6. The coupler arms 9 and 10 are pivotally supported on the camshafts 3 and 4 and, at their opposite ends, have bearings for the gears 7 and 8 respectively, and also for pivotally supporting the transverse coupler arm 11 which interconnects the coupler arms 9 and 10. The pivot axes of the camshafts 3 and 4 and, consequently, of the gears 5 and 6 are indicated by the numerals 12 and 13 and the axes of rotation of the intermediate gears 7 and 8 are indicated by the reference numerals 14 and 15, respectively. The coupler drive forming the control drive 2 is variable by pivotal movement of the coupler arms 9 and 10 about the axes of rotation 12 and 13 of the camshafts 3 and 4. Such a control movement is initiated by a control member 16 which is a control wheel which is rotatably supported on the front end of the camshaft bearing housing on a bearing pin 17 extending therefrom. The bearing pin 17 has an axis 18 which is also the axis of rotation of the control wheel forming the control member 16. The control wheel 16 carries at its one side adjacent the camshaft bearing housing 1 an eccentric portion 19 which is a collar formed eccentrically on the control wheel 16. A connecting rod 20 has one end supported on the eccentric portion 19 and at the opposite end a connecting rod eye 21 mounted onto the shaft 22 of the intermediate gear 8 concentrically with the axis 22 thereof which at the same time is the pivot axis of the interconnected coupler arms 10 and 11. As shown in FIG. 2, the support for the connecting rod eye 21 is formed by a part of shaft 22 which projects axially beyond the coupler arm 10 and is disposed in a plane extending normal to the axis 18 of the bearing pin 17 and through the eccentric collar 19. The gear structure 23 of the part 24 of the control member 16, which serves as the control wheel is disposed to the side of the eccentric collar in a plane normal to the bearing pin axis 18 and in alignment with the coupler drive 2 whereby the whole arrangement becomes very slim. However, the connecting rod 20 may also be disposed at the opposite side of the coupler drive 2 that is at its side remote from the front end wall of the bearing housing 1. This has the advantage that the coupler drive is closer to the bearing housing and the camshafts extensions beyond the bearing housing could therefore be shorter although the bearing pin 17 would have to be longer.

The control wheel is preferable a worm gear with a corresponding gear structure 23 which is in engagement with a worm or screw-type gear 25 as shown in FIG. 1. The worm 25 is mounted on the shaft 26 of the control motor 27 which is preferably a rod-like drive motor to provide for a slim arrangement wherein the motor axis is in alignment with the axis of the worm or screw type gear 25. The control motor 27 is also preferably mounted on the camshaft bearing housing 1 which however is not shown. Only a support structure 28 for the shaft 26 on the camshaft bearing housing 1 is shown in the drawing. Although the control motor is shown in FIG. 1 so arranged that its axis extends normal to a plane including the axis of rotation of the control member 16, it may of course be arranged at different angular positions if this is advantageous within the space constraints of the internal combustion engine.

It is further advantageous if the control path of the control member and, consequently, the control movement of the coupler drive is limited at least in one direction of movement by a stop 30 whereby the stop 30 facilitates proper setting of the control device. The stop 30 is preferably provided on the camshaft bearing housing 1. However, it can also be provided by a functional member such as a camshaft or the shaft of the control member. A cooperating counter stop is provided by the coupler links or the connecting rod and may be adjustable with respect to the coupler link or the connecting rod.

What is claimed is:

1. A variable valve control for an internal combustion engine having a cylinder head with a valve operating mechanism including intake and exhaust valves, a bearing housing mounted on said cylinder head, a first camshaft supported on said bearing housing for controlling the opening of the intake valves, a second camshaft supported on said bearing housing for controlling the closing of said intake valves, a control drive disposed on said bearing housing between said first and second camshafts for driving said second camshaft at variable angular positions relative to said first camshaft, a control wheel mounted on said bearing housing and including an eccentric portion, a connecting rod having one end mounted onto said eccentric portion and its opposite end operatively connected to said control drive for controlling said control drive, a control motor including a shaft with a drive pinion in engagement with said control wheel for rotating said control wheel, said control wheel being mounted on said bearing housing sidewardly displaced from said control drive, and said control motor shaft with said drive pinion extending transverse to an axis of rotation of said control wheel and being supported on said camshaft bearing housing.

2. A variable valve control according to claim 1, wherein said control drive is a four-gear coupler drive including first and second gears mounted on said first and second camshafts and intermediate gears mounted on coupler arms supported so as to be pivotable about the axes of said first and second camshafts respectively, and carrying intermediate gear shafts with intermediate gears in engagement with said first and second gears mounted on said camshafts and an intermediate coupler arm holding said intermediate gears in engagement with each other, said connecting rod being connected to one of said intermediate gear shafts.

3. A variable valve control according to claim 1, wherein said control wheel is a worm gear and said drive pinion is a worm in engagement with said worm gear.

4. A variable valve control according to claim 1, wherein said eccentric portion is a collar formed on said control wheel.

5. A variable valve control according to claim 1, wherein said control motor is a rod-like drive motor.

6. A variable valve control according to claim 1, wherein at least one stop is provided for limiting the control movements of said control wheel.

7. A variable valve control according to claim 6, wherein the at least one stop is formed by a projection integrally formed with the bearing housing.

8. A variable valve control according to claim 7, wherein said stop is arranged in the path of movement of said coupler drive.

* * * * *